US011012796B2

(12) United States Patent
Andersson et al.

(10) Patent No.: US 11,012,796 B2
(45) Date of Patent: May 18, 2021

(54) SYSTEM FOR ADJUSTING MAGNETIC RETENTION FORCE IN AUDITORY PROSTHESES

(71) Applicant: COCHLEAR LIMITED, Macquarie University (AU)

(72) Inventors: Marcus Andersson, Macquarie University (AU); Johan Gustafsson, Macquarie University (AU); Henrik Fyrlund, Macquarie University (AU); Stefan Magnander, Macquarie University (AU); Goran Bjorn, Macquarie University (AU)

(73) Assignee: Cochlear Limited, Macquarie University (AU)

( * ) Notice: Subject to any disclaimer, the term of this patent is extended or adjusted under 35 U.S.C. 154(b) by 284 days.

(21) Appl. No.: 15/985,811

(22) Filed: May 22, 2018

(65) Prior Publication Data

US 2018/0288538 A1 Oct. 4, 2018

Related U.S. Application Data

(63) Continuation of application No. 14/314,346, filed on Jun. 25, 2014, now abandoned.

(51) Int. Cl.
*H04R 25/00* (2006.01)

(52) U.S. Cl.
CPC ..... *H04R 25/606* (2013.01); *H04R 2225/67* (2013.01)

(58) Field of Classification Search
CPC ..... H04R 2225/67; H04R 25/606
USPC ..... 600/25
See application file for complete search history.

(56) References Cited

U.S. PATENT DOCUMENTS 4,352,960 A * 10/1982 Dormer ..... A61N 1/372 607/57
4,726,378 A * 2/1988 Kaplan ..... A61N 1/36036 607/115
4,736,747 A * 4/1988 Drake ..... A61N 1/375 607/61
6,358,281 B1 * 3/2002 Berrang ..... A61N 1/36036 600/25

(Continued)

FOREIGN PATENT DOCUMENTS

KR 101297828 8/2013

OTHER PUBLICATIONS

PCT International Search Report and Written Opinion in International Application PCT/IB2015/001669, dated Jan. 26, 2016, 12 pages.

*Primary Examiner* — Navin Natnithithadha
*Assistant Examiner* — Sunita Reddy
(74) *Attorney, Agent, or Firm* — Edell, Shapiro & Finnan, LLC

(57) ABSTRACT

An external portion of an auditory prosthesis includes an external magnet that interacts with an implanted magnet to hold the external portion against the skin of a recipient. A magnetic component can be disposed proximate either or both of the external magnet or implanted magnet to channel the magnetic field associated therewith. The magnetic component can be moved relative to its associated magnet so as to adjust the magnetic field, and thus, the retention force between the magnets.

20 Claims, 11 Drawing Sheets

(56) References Cited

U.S. PATENT DOCUMENTS

2003/0163021 A1* 8/2003 Miller ..... H04R 25/606 600/25
2004/0210103 A1* 10/2004 Westerkull ..... H04R 25/606 600/25
2005/0001703 A1* 1/2005 Zimmerling ..... H02K 35/02 335/220
2007/0053536 A1* 3/2007 Westerkull ..... H04R 25/606 381/326
2009/0192345 A1 7/2009 Westerkull
2009/0209806 A1 8/2009 Hakansson
2009/0248155 A1* 10/2009 Parker ..... H04R 25/00 623/10
2011/0158443 A1 6/2011 Asnes
2011/0268303 A1* 11/2011 Ahsani ..... H04R 11/02 381/326
2011/0301404 A1 12/2011 Bern
2012/0080039 A1 4/2012 Siegert
2012/0088956 A1 4/2012 Asnes et al.
2012/0172659 A1 7/2012 Ball
2012/0253104 A1* 10/2012 Andersson ..... A61F 11/045 600/25
2012/0296155 A1 11/2012 Ball
2012/0302822 A1* 11/2012 Van Himbeeck .... H04R 25/606 600/25
2012/0302823 A1* 11/2012 Andersson ..... H04R 25/606 600/25
2013/0018218 A1 1/2013 Haller
2013/0150657 A1* 6/2013 Leigh ..... H04R 25/606 600/25
2013/0163791 A1* 6/2013 Qi ..... H04R 9/02 381/151
2013/0172662 A1* 7/2013 Menzl ..... H04R 25/606 600/25
2013/0182874 A1* 7/2013 Buehlmann ..... H04R 25/55 381/312
2013/0281764 A1 10/2013 Bjorn
2014/0012069 A1 1/2014 Ball
2014/0012071 A1* 1/2014 Nagl ..... H04R 25/606 600/25
2014/0121449 A1* 5/2014 Kasic ..... H04R 25/606 600/25
2014/0121451 A1 5/2014 Kasic

* cited by examiner

SYSTEM FOR ADJUSTING MAGNETIC RETENTION FORCE IN AUDITORY PROSTHESES

CROSS-REFERENCE TO RELATED APPLICATION

This application is a continuation of U.S. patent application Ser. No. 14/314,346, filed Jun. 25, 2014, entitled, "SYSTEM FOR ADJUSTING MAGNETIC RETENTION FORCE IN AUDITORY PROSTHESES". The disclosure of this priority application is hereby incorporated by reference in its entirety into the present application.

BACKGROUND

An auditory prosthesis can be placed behind the ear to deliver a stimulus in the form of a vibration to the skull of a recipient. These types of auditory prosthesis are generally referred to as transcutaneous bone conduction devices. The auditory prosthesis receives sound via a microphone located on a head-mounted sound processor, often referred to as a "button sound processor." The head-mounted sound processor is secured to the head with a magnet that interacts with a magnet implantable in the head of the recipient. Processed sound signals are delivered as a vibration stimulus from the external portion to the implanted magnet, which vibrate the skull of the recipient. The magnetic force generated by the external magnet and the implanted magnet can cause discomfort if too strong, or the external portion can become disengaged if the force is too weak.

SUMMARY

An external portion of an auditory prosthesis includes an external magnet that interacts with an implanted magnet to hold the external portion against the skin. In some situations, a stronger holding force is preferable. For example, if a recipient in involved in a vigorous activity, such as running or swimming, a stronger force is desired to keep the external portion attached and in place. However, a weaker holding force is desirable during less vigorous activities, often for comfort. For example, a stronger holding force can compress the skin, which can lead to recipient discomfort and, potentially, skin necrosis. To meet the dynamic needs of a recipient, then, a magnetic component can be disposed proximate either or both of the external magnet and/or implanted magnet to channel the magnetic field associated therewith. This field channeling effects the magnetic force between the two magnets, and thus the retention force on the external portion. The magnetic component can be moved relative to its associated magnet so as to adjust the magnetic field, and thus, the retention force. This allows the recipient to easily adjust her auditory prosthesis, based on her desired activity.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

The technologies described herein can typically be utilized with transcutaneous bone conduction devices. Such devices utilize one or more magnets disposed in an external portion and/or implanted portion of the bone conduction device. The magnetic field of an external magnet interacts with a magnetic field of a magnet disposed in an implanted portion of the bone conduction device. In embodiments, a magnetic component can be disposed proximate either magnet to channel the magnetic field to thereby alter the holding or retention force of the paired magnets (e.g., the external magnet(s) and the implanted magnet(s)). A change in separation distance of a magnetic component relative to its associated magnet adjusts the holding force of the paired magnets. Additionally, a change in orientation of the magnetic component relative to its associated magnet also changes the holding force. Adjusting, controlling, or otherwise regulating the holding force can be desirable to accommodate more vigorous activity, to increase comfort, reduce the likelihood of necrosis of the skin, etc. In that regard, the embodiments disclosed herein can be utilized with any type of multi-component medical device where one portion of the device is implanted in a recipient, and the other portion is secured to the skin of a patient via a force generated by a magnetic field. For example, other types of auditory prostheses, such as cochlear implants, middle ear prostheses, and direct acoustic stimulators utilize a similar configuration where an external magnet mates with an implanted magnet to hold the external portion to the skin.

The technologies described herein are also applicable to other types of auditory prostheses. For example, a percutaneous bone conduction prosthesis utilizes an anchor that penetrates the skin of the head. An external portion of the auditory prosthesis is secured to the anchor with a snap connection. By utilizing the technologies described herein, the anchor can be manufactured in whole or in part of a magnetic material, and a mating magnetic material can be disposed in the external portion to mate with the anchor, either alone, or also in conjunction with a snap connection. Additionally, the technologies described herein can be utilized in conjunction with behind-the-ear (BTE) auditory prostheses that deliver stimuli to the recipient in the form of electrical signals or vibrations. Accordingly, the technologies described herein can be similarly leveraged in such devices. For clarity, however, the technologies will be described in the context of auditory prostheses that are bone conduction devices.

Figure 1A:
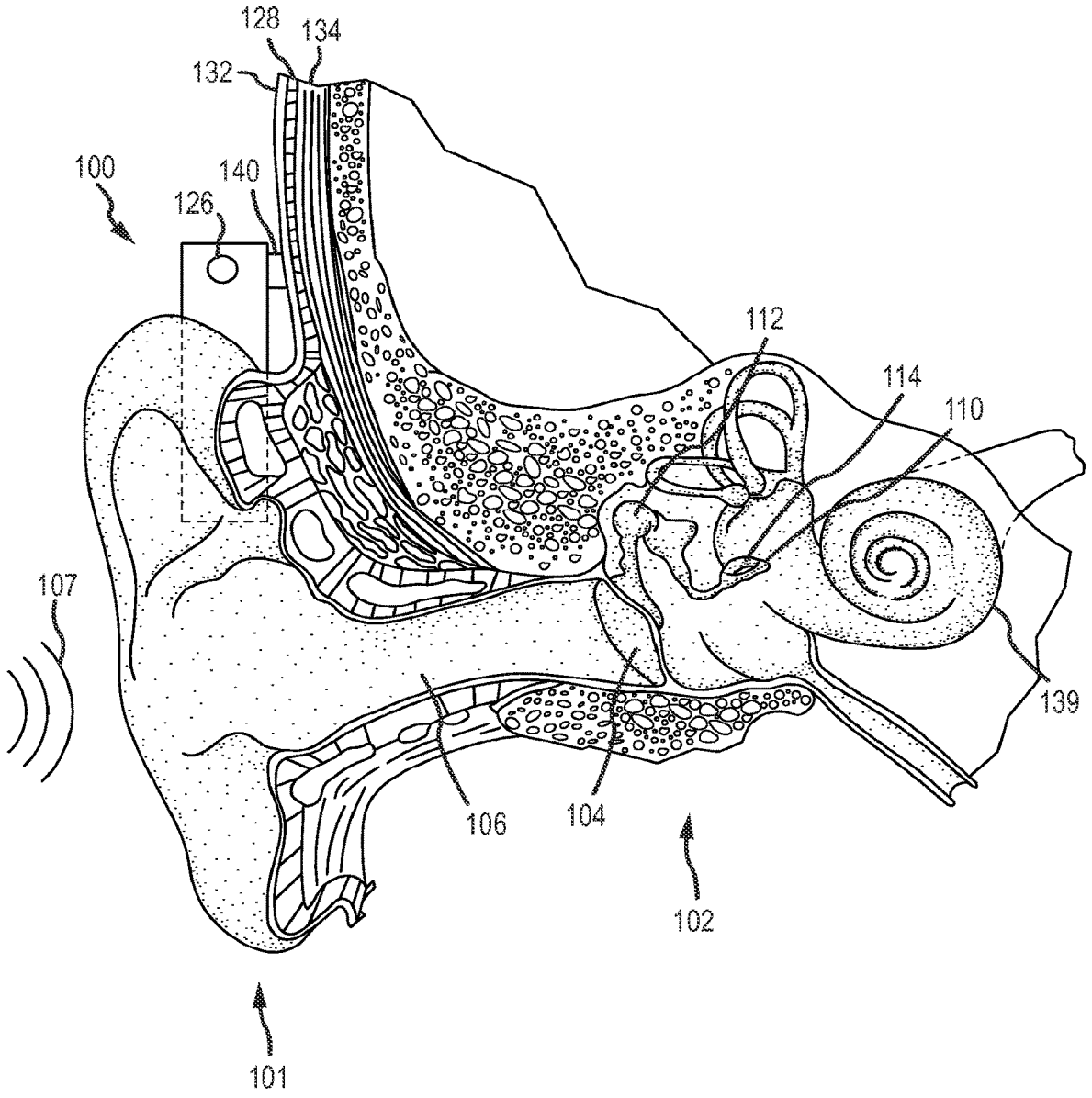
FIG. 1A depicts a partial perspective view of a percutaneous bone conduction device worn on a recipient.

FIG. 1A depicts a partial perspective view of a percutaneous bone conduction device 100 positioned behind outer ear 101 of the recipient and comprises a sound input element 126 to receive sound signals 107. The sound input element 126 can be a microphone, telecoil or similar sound input element. In the present example, sound input element 126 may be located, for example, on or in bone conduction device 100, or on a cable extending from bone conduction device 100. Also, bone conduction device 100 comprises a sound processor (not shown), a vibrating electromagnetic actuator and/or various other operational components.

More particularly, sound input device 126 converts received sound signals into electrical signals. These electrical signals are processed by the sound processor. The sound processor generates control signals that cause the actuator to vibrate. In other words, the actuator converts the electrical signals into mechanical force to impart vibrations to skull bone 136 of the recipient.

Bone conduction device 100 further includes coupling apparatus 140 to attach bone conduction device 100 to the recipient. In the example of FIG. 1A, coupling apparatus 140 is attached to an anchor system (not shown) implanted in the recipient. An exemplary anchor system (also referred to as a fixation system) may include a percutaneous abutment fixed to the recipient's skull bone 136. The abutment extends from skull bone 136 through muscle 134, fat 128 and skin 132 so that coupling apparatus 140 may be attached thereto. Such a percutaneous abutment provides an attachment location for coupling apparatus 140 that facilitates efficient transmission of mechanical force.

It is noted that sound input element 126 can comprise devices other than a microphone, such as, for example, a telecoil, etc. In an exemplary embodiment, sound input element 126 can be located remote from the BTE device and can take the form of a microphone or the like located on a cable or can take the form of a tube extending from the BTE device, etc. Alternatively, sound input element 126 can be subcutaneously implanted in the recipient, or positioned in the recipient's ear canal or positioned within the pinna. Sound input element 126 can also be a component that receives an electronic signal indicative of sound, such as, from an external audio device. For example, sound input element 126 can receive a sound signal in the form of an electrical signal from an MP3 player or a smartphone electronically connected to sound input element 126.

The sound processing unit of the BTE device processes the output of the sound input element 126, which is typically in the form of an electrical signal. The processing unit generates control signals that cause an associated actuator to vibrate. In other words, the actuator converts the electrical signals into mechanical vibrations for delivery to the recipient's skull. These mechanical vibrations are delivered by an external portion of the auditory prosthesis 100, as described below.

Figure 1B:
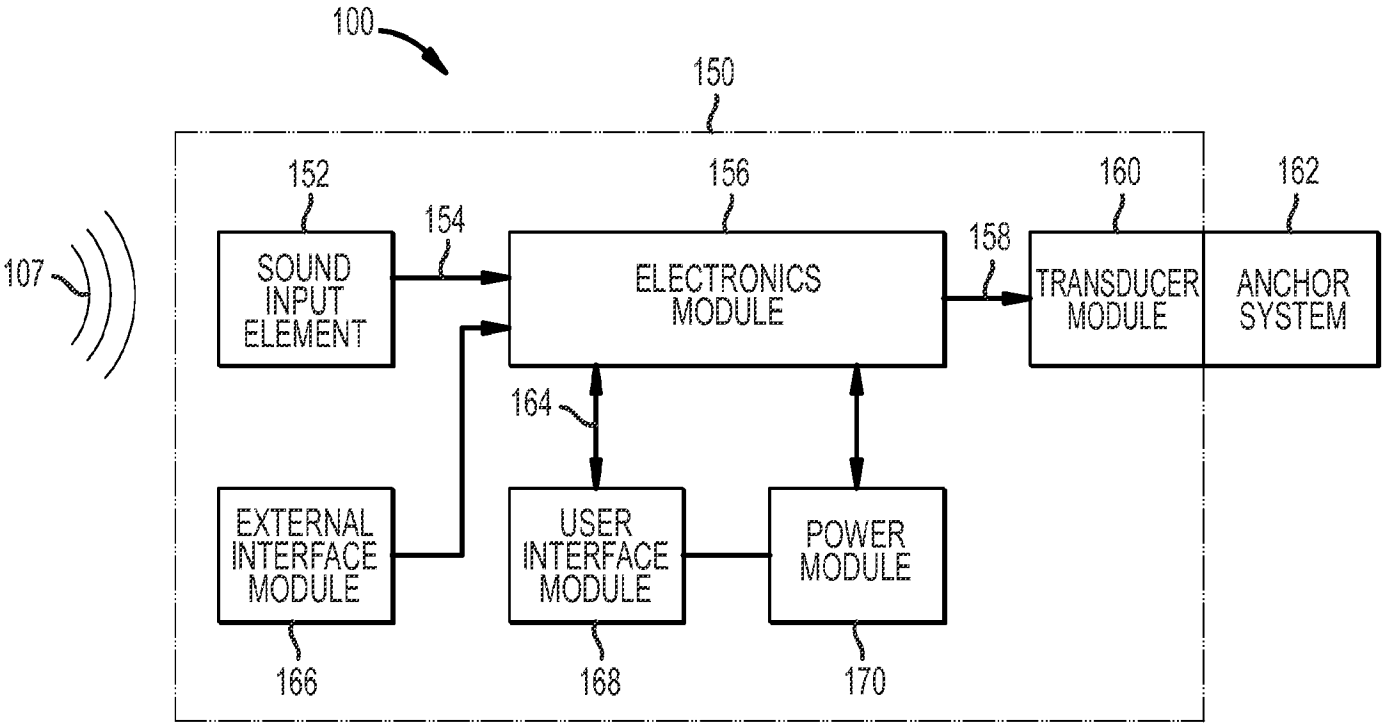
FIG. 1B is a schematic diagram of a percutaneous bone conduction device.

FIG. 1B is a schematic diagram of a percutaneous bone conduction device 100. Sound 107 is received by sound input element 152. In some arrangements, sound input element 152 is a microphone configured to receive sound 107, and to convert sound 107 into electrical signal 154. Alternatively, sound 107 is received by sound input element 152 as an electrical signal. As shown in FIG. 1B, electrical signal 154 is output by sound input element 152 to electronics module 156. Electronics module 156 is configured to convert electrical signal 154 into adjusted electrical signal 158. As described below in more detail, electronics module 156 may include a sound processor, control electronics, transducer drive components, and a variety of other elements.

As shown in FIG. 1B, transducer 160 receives adjusted electrical signal 158 and generates a mechanical output force in the form of vibrations that is delivered to the skull of the recipient via anchor system 162, which is coupled to bone conduction device 100. Delivery of this output force causes motion or vibration of the recipient's skull, thereby activating the hair cells in the recipient's cochlea (not shown) via cochlea fluid motion.

FIG. 1B also illustrates power module 170. Power module 170 provides electrical power to one or more components of bone conduction device 100. For ease of illustration, power module 170 has been shown connected only to user interface module 168 and electronics module 156. However, it should be appreciated that power module 170 may be used to supply power to any electrically powered circuits/components of bone conduction device 100.

User interface module 168, which is included in bone conduction device 100, allows the recipient to interact with bone conduction device 100. For example, user interface module 168 may allow the recipient to adjust the volume, alter the speech processing strategies, power on/off the device, etc. In the example of FIG. 1B, user interface module 168 communicates with electronics module 156 via signal line 164.

Bone conduction device 100 may further include external interface module that may be used to connect electronics module 156 to an external device, such as a fitting system. Using external interface module 166, the external device, may obtain information from the bone conduction device 100 (e.g., the current parameters, data, alarms, etc.) and/or modify the parameters of the bone conduction device 100 used in processing received sounds and/or performing other functions.

In the example of FIG. 1B, sound input element 152, electronics module 156, transducer 160, power module 170, user interface module 168, and external interface module have been shown as integrated in a single housing, referred to as housing 150. However, it should be appreciated that in certain examples, one or more of the illustrated components may be housed in separate or different housings. Similarly, it should also be appreciated that in such embodiments, direct connections between the various modules and devices are not necessary and that the components may communicate, for example, via wireless connections.

Figure 2:
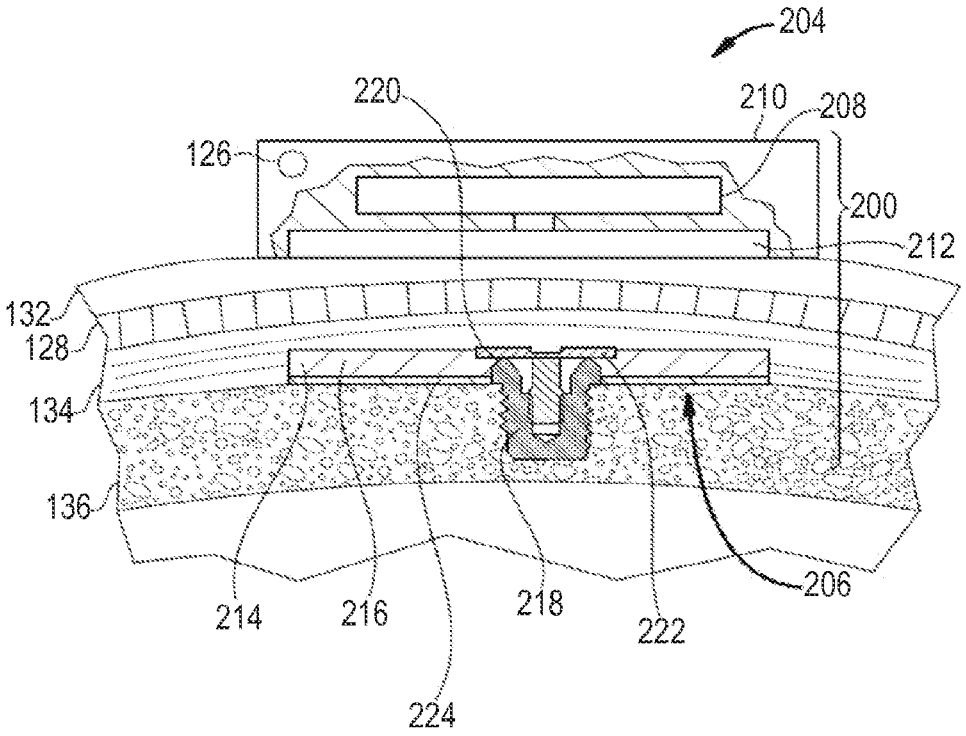
FIG. 2 depicts a cross-sectional schematic view of a passive transcutaneous bone conduction device worn on a recipient.

FIG. 2 depicts an exemplary embodiment of a transcutaneous bone conduction device 200 that includes an external portion 204 and an implantable portion 206. The transcutaneous bone conduction device 200 of FIG. 2 is a passive transcutaneous bone conduction device in that a vibrating actuator 208 is located in the external portion 204. Vibrating actuator 208 is located in housing 210 of the external component, and is coupled to plate 212. Plate 212 can be in the form of a permanent magnet and/or in another form that generates and/or is reactive to a magnetic field, or otherwise permits the establishment of magnetic attraction between the external portion 204 and the implantable portion 206 sufficient to hold the external portion 204 against the skin of the recipient. Magnetic attraction can be further enhanced by utilization of a magnetic implantable plate 216. A single external magnet 212 of a first polarity and a single implantable magnet 216 of a second polarity, are depicted in FIG. 2. In alternative embodiments, multiple magnets in both the external portion 204 and implantable portion 206 can be utilized. The retention force adjustment technologies described further herein can be utilized in conjunction with external and implantable portions having either single or multiple magnets. In a further alternative embodiment the plate 212 can include an additional plastic or biocompatible housing (not shown) that encapsulates plate 212 and contacts the skin of the recipient.

In an exemplary embodiment, the vibrating actuator 208 is a device that converts electrical signals into vibration. In operation, sound input element 126 converts sound into electrical signals. Specifically, the transcutaneous bone conduction device 200 provides these electrical signals to vibrating actuator 208, or to a sound processor (not shown) that processes the electrical signals, and then provides those processed signals to vibrating actuator 208. The vibrating actuator 208 converts the electrical signals (processed or unprocessed) into vibrations. Because vibrating actuator 208 is mechanically coupled to plate 212, the vibrations are transferred from the vibrating actuator 208 to plate 212. Implantable plate assembly 214 is part of the implantable portion 206, and is made of a ferromagnetic material that can be in the form of a permanent magnet, that generates and/or is reactive to a magnetic field, or otherwise permits the establishment of a magnetic attraction between the external portion 204 and the implantable portion 206 sufficient to hold the external portion 204 against the skin 132 of the recipient. Accordingly, vibrations produced by the vibrating actuator 208 of the external portion 204 are transferred from plate 212 across the skin 132 to implantable plate 216 of implantable plate assembly 214. This can be accomplished as a result of mechanical conduction of the vibrations through the skin 132, resulting from the external portion 204 being in direct contact with the skin 132 and/or from the magnetic field between the two plates 212, 216. These vibrations are transferred without a component penetrating the skin 132, fat 128, or muscular 134 layers on the head.

As can be seen, the implantable plate assembly 214 is substantially rigidly attached to bone fixture 218 in this embodiment. Implantable plate assembly 214 includes a through hole 220 that is contoured to the outer contours of the bone fixture 218, in this case, a bone screw that is secured to the bone 136 of the skull. This through hole 220 thus forms a bone fixture interface section that is contoured to the exposed section of the bone fixture 218. In an exemplary embodiment, the sections are sized and dimensioned such that at least a slip fit or an interference fit exists with respect to the sections. Plate screw 222 is used to secure implantable plate assembly 214 to bone fixture 218. As can be seen in FIG. 2, the head of the plate screw 222 is larger than the hole through the implantable plate assembly 214, and thus the plate screw 222 positively retains the implantable plate assembly 214 to the bone fixture 218. In certain embodiments, a silicon layer 224 is located between the implantable plate 216 and bone 136 of the skull.

Figure 3:
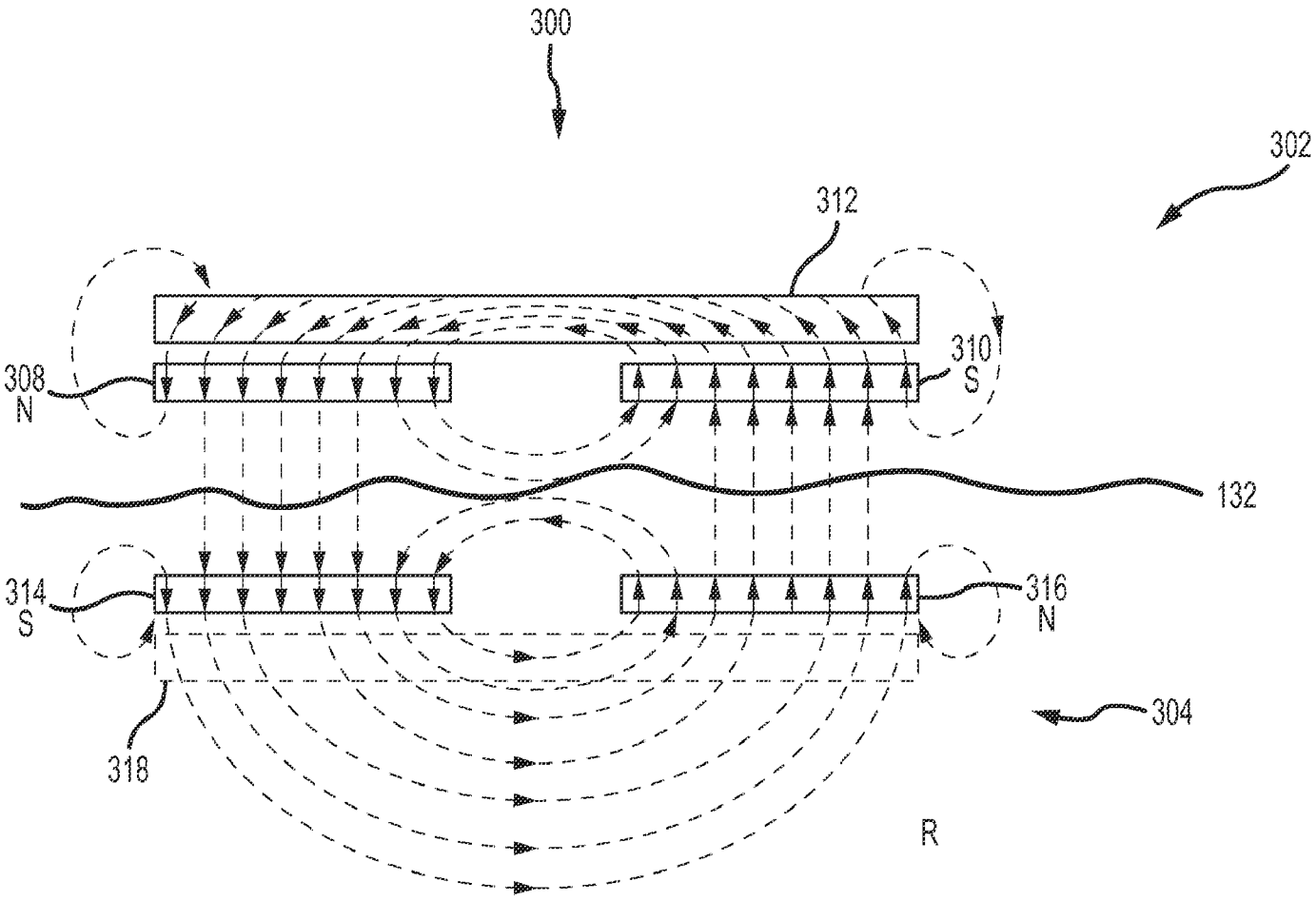
FIG. 3 depicts a partial cross-sectional schematic view of a passive transcutaneous bone conduction device worn on a recipient.

FIG. 3 depicts a partial cross-sectional schematic view of a passive transcutaneous bone conduction device 300 for a recipient R. Only skin 132 of the recipient R is depicted for clarity. The bone conduction device 300 includes an external portion 302 and an implantable portion 304. For clarity, only certain components of each of the external portion 302 and the implantable portion 304 are depicted. Other components in the external portion 302 and the implantable portion 304, e.g., sound processing components, batteries, microphones, actuators, anchors, etc., are described above, but not depicted in FIG. 3. The external portion 302 includes a plurality of external magnets 308, 310. In this embodiment, magnet 308 has a "north" polarity and magnet 310 has a "south" polarity. Disposed proximate each magnet 308, 310 is a magnetic component 312, the function of which is described in further detail below. The implantable portion 304 also includes two implantable magnets 314, 316, the polarities of which are oriented in a reversed configuration relative to the external magnets 308, 310 of the external portion 302. The magnets 314, 316 can be disposed in a housing or secured directly to the skull, as depicted in FIG. 1B above. In an alternative embodiment, one or more magnetic components 318 can be disposed proximate the implantable magnets 314, 316.

Magnetic flux generated by the magnets 308, 310, 314, 316 is also depicted in FIG. 3. The magnetic field, and especially stray portions thereof, can interfere with the operation of the sound processor or other components disposed in the external portion 302. Stray portions are generally not depicted in FIG. 3. Forces and/or torques are generated on components disposed in the external portion 302, which can compromise the functionality of the actuator, by effecting the functionality of the actuator suspension, thus leading to worsened feedback performance of the device 300. The performance of the vibrating actuator (if electromagnetic) can also be worsened by stray magnetic fields penetrating the actuator, thus reducing sensitivity and causing distortion. Utilization of magnetic components 312 (and 318, if present) can reduce these interferences and further improve functionality of the auditory prosthesis 300. The magnetic components 312, 318 channel the magnetic flux as depicted, to reduce the stray magnetic fields, thus correcting or minimizing the above-identified and other problems.

Magnetic Resonance Image (MM) compatibility also can be compromised by the implanted magnets 314, 316, e.g. due to: forces and torques that are generated on the implanted components; magnetic material generating image artefacts; and the implanted magnets 314, 316 being demagnetized by the static magnetic field of the MRI. It has been discovered that use of the implanted magnetic component 318 helps reduce or eliminate these problems as well.

The magnetic components 312, 318 can be manufactured of soft magnetic material in the form of thin plates, thick blocks, or other elements of varying dimensions and shapes. The presence of the magnetic components 312, 318 proximate the magnets 308, 310, 314, 316 decreases the magnetic reluctance (also referred to as magnetic resistance), as compared to magnets without associated magnetic components. This is because the magnetic permeability of the magnetic components 312, 318 is significantly higher compared to air or the various tissues of the body. The effect on the magnetic field is depicted in FIG. 3, where the field is channeled through the magnetic components 312, 318. This reduction in magnetic reluctance increases the retention force of the magnetic field. The amount of material utilized in the magnetic components 312, 318 depends on the saturation polarization (Bsat). In certain embodiments, the magnetic components 312, 138 can be pure iron or cobalt-iron (having a formulation of approximately 50% cobalt). Other materials are also contemplated within the scope of this disclosure. Additionally, moving the magnetic components 312, 318 relative to the magnets 308, 310, 314, 316, as described below, can alter the magnetic reluctance and retention force.

FIGS. 4A-4D depict partial cross-sectional schematic views of position adjustment systems for an external portion 400 of a passive transcutaneous bone conduction device. The external portion 400 includes a housing 402 and two external magnets 404, 406 disposed therein. A magnetic component 408, 410 is disposed proximate each of the magnets 404, 406, respectively. In an alternative embodiment, a single magnetic component can be used. The magnetic components 408, 410 are mounted on a base 412 that allows the distance d between the magnetic components 408, 410 and the magnets 404, 406 to be adjusted. The base 412 can be made from a non-magnetic material, or can be a non-magnetic material incorporated into the magnetic components 408, 410. By adjusting this distance d, the magnetic reluctance can be adjusted, with the results as described above. Although one base 412 is depicted, in embodiments each magnetic component 408, 410 can be mounted on a dedicated base and adjusted separately. The base 412 is engaged, in FIG. 4A, with a position adjustment system or element, in this case, a threaded rod 414 with a mating threaded connection 416. Thus, rotation of the base 412 translates the base axially A along the threaded rod 414. This increases or decreases the distance d between the magnetic components 408, 410 and the magnets 404, 406, altering the magnetic reluctance, since magnetic reluctance depends on the size of the air gap (e.g., the separation distance d). Altering the magnetic reluctance adjusts the retention force between the external magnets 404, 406 and implanted magnets (not shown). For example, a reduction in reluctance due to a reduced separation distance d increases the retention force. Conversely, increasing the separation distance d increases reluctance and reduces retention force.

Figure 4A:
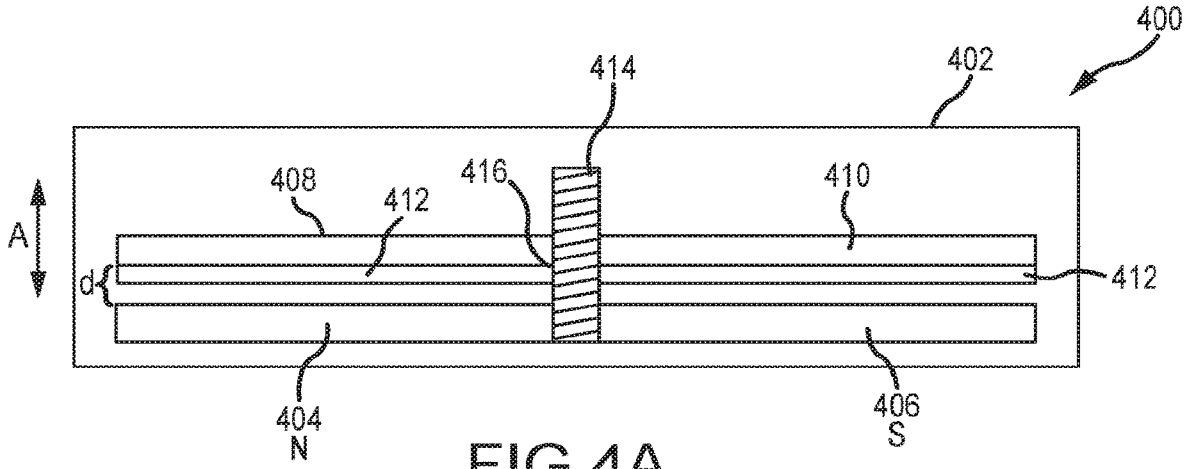
FIGS. 4A-4D depict partial cross-sectional schematic views of position adjustment systems for a passive transcutaneous bone conduction device.
Figure 4B:
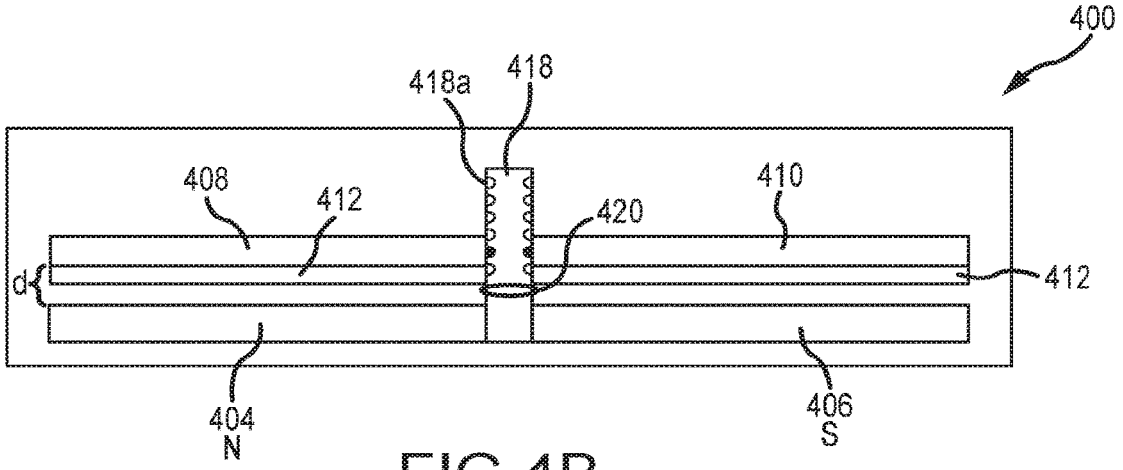
Figure 4C:
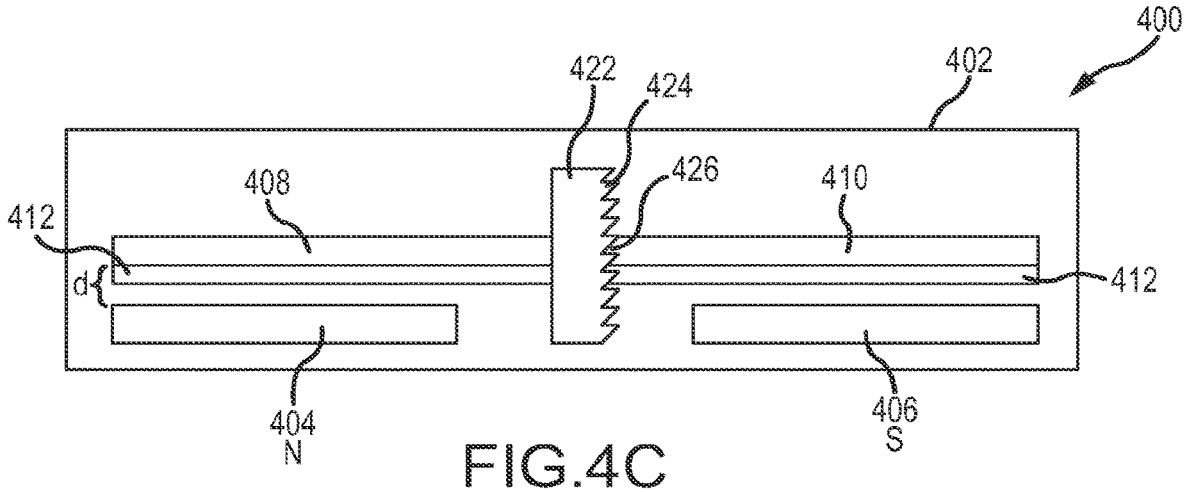
Figure 4D:
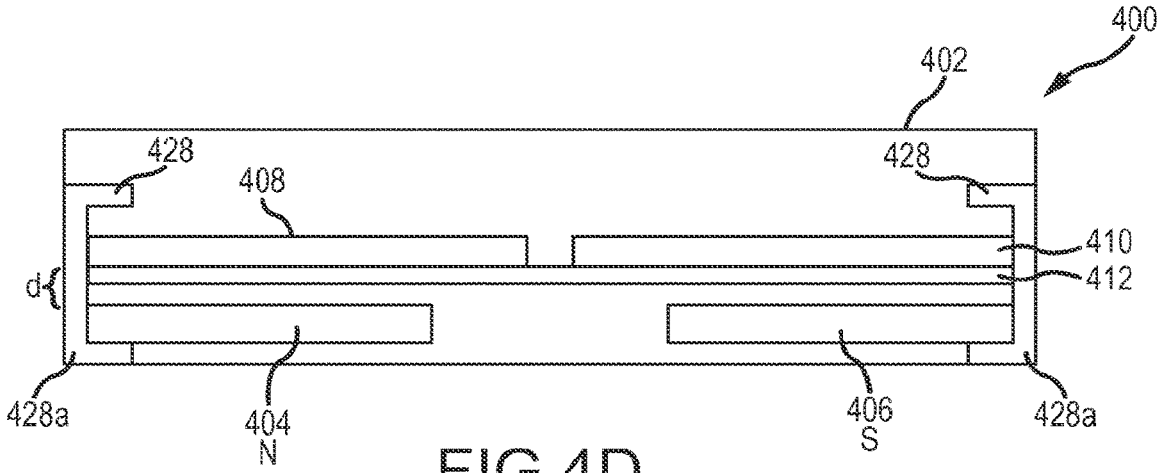

Other position adjustment systems or elements are depicted in FIGS. 4B-4D. Elements common to the embodiment of FIG. 4A are generally not described. In FIG. 4B, the base 412 is configured to translate along a rail or shaft 418. The shaft 418 can have a smooth surface and the base can incorporate a lock 420, clamp, or other mechanism to hold the base 412 in a desired position. In another embodiment, the lock can engage with a portion of the housing 402. In another embodiment, the shaft 418 can include a number of detents 418*a* that engage with a mating projection on the base 412. FIG. 4C depicts an embodiment of a position adjustment system that incorporates a central ratchet 422. The ratchet 422 includes a number of teeth 424 that can be selectively engaged by a mating tooth 426 on the base 412. FIG. 4D depicts an embodiment of a position adjustment system that includes a frame 428 that engages with the base 412. The frame 428 can include a plurality of members 428*a* that substantially surround the base 412 so as to evenly support the base 412 as it moves. Locks, detents, or a ratchet configuration, similar to those described above, can be incorporated to set the position of the base 412. In other embodiments the magnetic components 408, 410 can be connected directly to the position adjustment system, without the need for a base, depending on the configuration of the magnetic components 408, 410.

Figure 5A:
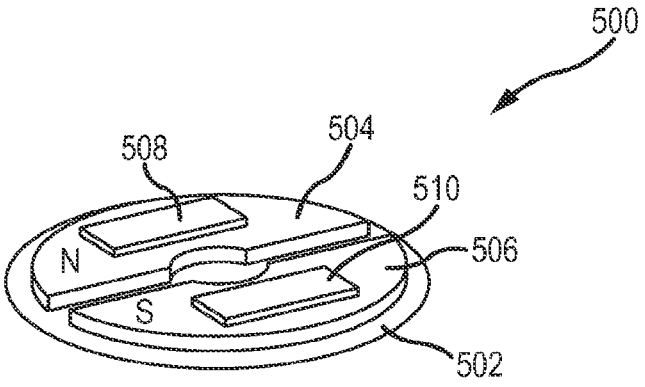
FIGS. 5A and 5B depict partial perspective views of an external portion of an auditory prosthesis, having magnetic components in a first position and second position, respectively.
Figure 5B:
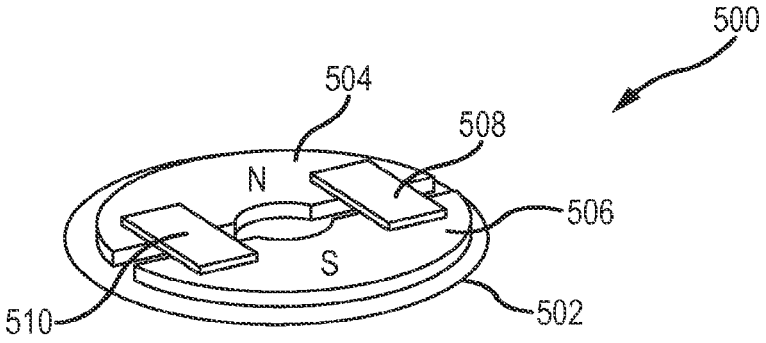

FIGS. 5A and 5B depict partial perspective views of an external portion 500 of an auditory prosthesis, having substantially rectangular magnetic components 508 in a first position and second position, respectively. The external portion 500 includes a housing 502 in which two magnets 504, 506 are disposed. The magnets 504, 506 are of opposing polarities. Magnetic components 508 are movably disposed relative to the magnets 504, 506. In FIG. 5A, the magnetic components are oriented in "zero" position, where both of the magnetic components 508 are disposed proximate only one of the two magnets 504, 506. Thus, in this configuration, there is no channeling of the magnetic field from the north magnet 504 to the south magnet 506. In FIG. 5B, the magnetic components 508 have been rotated about 90 degrees relative to the magnets 504, 506. Since each magnetic component 508 bridges the north magnet 504 and the south magnet 506, the magnetic field is short-circuited. Thus, the magnetic field is channeled, via the magnetic components 508, towards the south magnet 506. When magnetic components 508 are disposed as depicted in FIG. 5B, the retention force of the magnetic field is increased between the external magnets 504, 506 and implantable magnets. The magnetic components 508 can be disposed on a base that allows the magnetic components 508 to be oriented relative to the magnets without increasing the separation distance between the magnets 504, 506 and the magnetic components 508. In other embodiments, a position adjustment system can alter both a separation distance and an orientation of the magnetic components 508, relative to the magnets 504, 506. The threaded rod position adjustment system depicted in FIG. 4A is one example of such a rotatable and separable system.

Figure 6A:
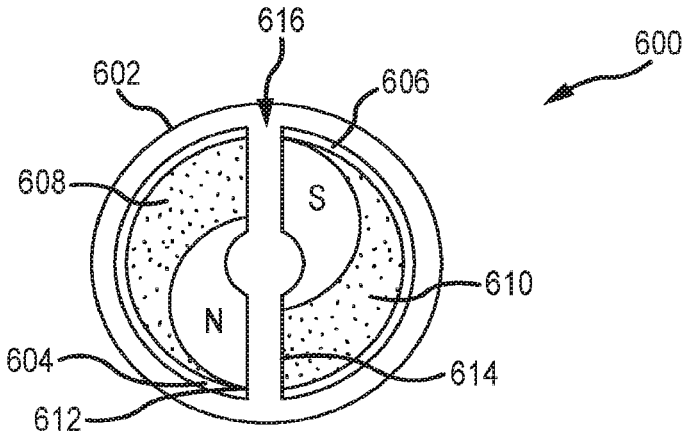
FIGS. 6A-6C depict top cross-sectional schematic views of an external portion of an auditory prosthesis, having magnetic components in a first position, a second position, and a third position, respectively.
Figure 6B:
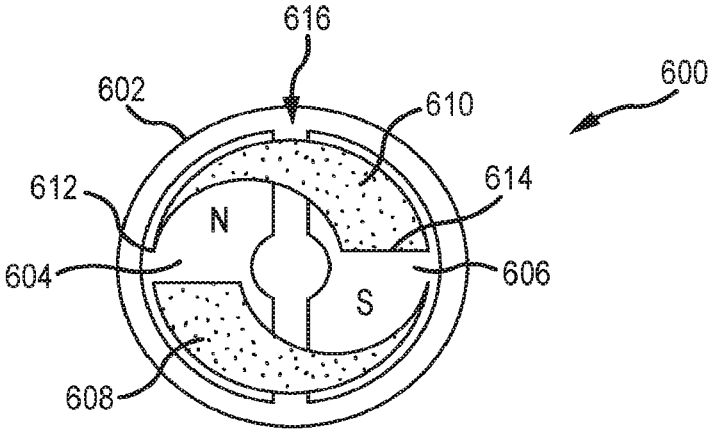
Figure 6C:
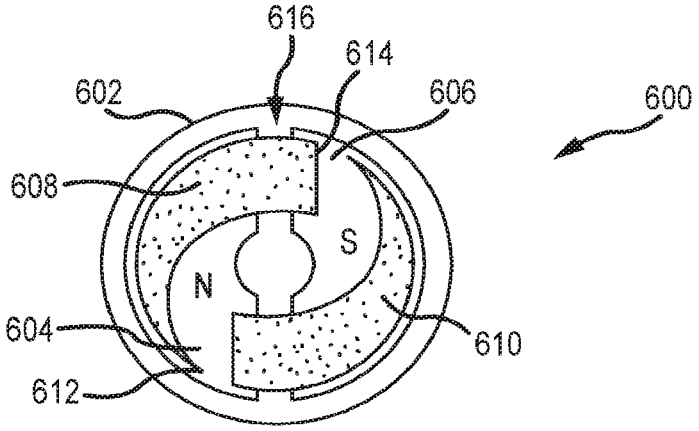

FIGS. 6A-6C depict top cross-sectional schematic views of an external portion 600 of an auditory prosthesis, having magnetic components 608 in a first position, a second position, and a third position, respectively. The external portion 600 includes a housing 602 in which two magnets 604, 606 are disposed. In other embodiments, a pressure plate that transmits vibrations to the skull may form this part of the housing 602. The magnets 604, 606 are of opposing polarities. Crescent-shaped magnetic components 608, 610 are movably disposed relative to the magnets 604, 606. The magnetic components 608, 610 each have a narrow portion proximate a tip 612 thereof and a wide cross-sectional area proximate a base 614 thereof. The magnetic components 608, 610 are configured such that the cross-sectional area increases from the tip 612 to the base 614. When either magnetic component 608, 610 is disposed such that a portion of the component 608, 610 proximate the tip 612 bridges the gap 616 between the north magnet 604 and the south magnet 606, there is almost no short-circuiting (channeling) of the magnet flux. In such an orientation, the retention force with an implanted magnet is less than the retention force when a portion of the components 608, 610 proximate the base 614 bridges the gap 616. Thus, in FIG. 6A, where no portion of the magnetic components 608, 610 bridge the gap 616, the retention force with an implanted magnet is at a minimum. When the magnetic components 608, 610 are rotated about 90 degrees, e.g., to the orientation depicted in FIG. 6B, retention force increases, since there is a greater volume of magnetic components 608, 610 bridging the gap 616 between the magnets 604, 606. When the magnetic components 608, 610 are rotated a further 90 degrees, e.g., to the orientation depicted in FIG. 6C, retention force increases to a maximum, since there is an even greater volume of magnetic components 608, 610 bridging the gap 616 between the magnets 604, 606. Depending on the structure of the position adjustment mechanism, the magnetic component 608 can be positioned in any number of orientations between those depicted in FIGS. 6A and 6C.

Figure 7A:
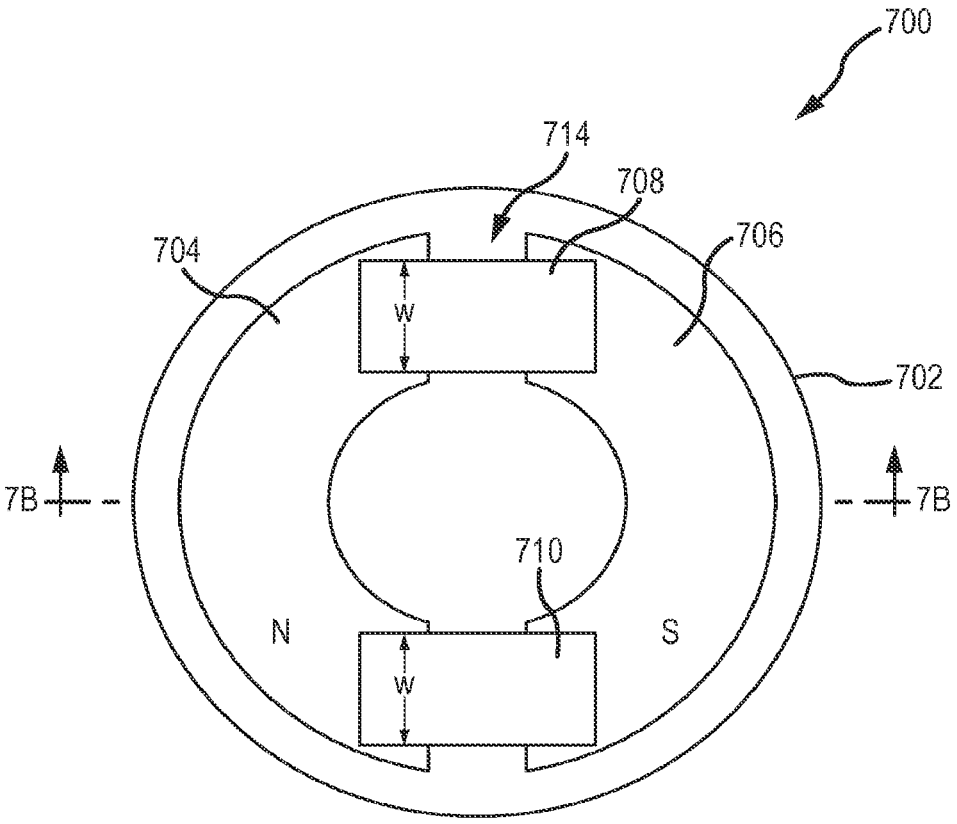
FIGS. 7A and 7B depict a top cross-sectional schematic view and a partial cross-sectional view, respectively, of an external portion of an auditory prosthesis.
Figure 7B:
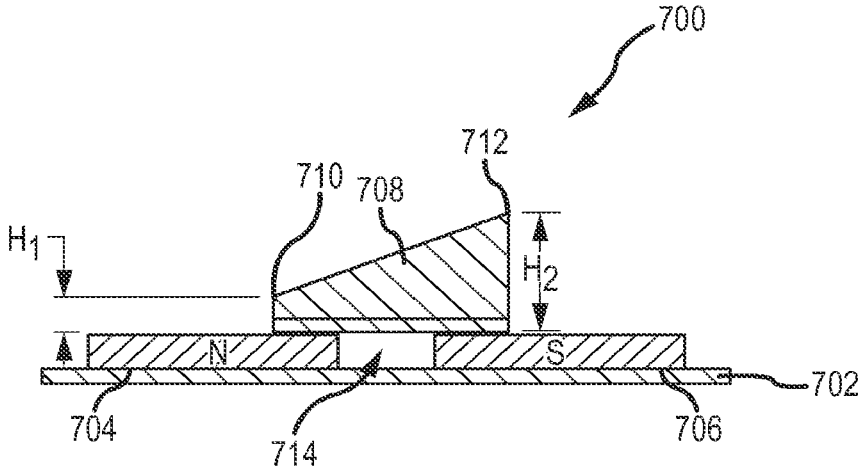

FIGS. 7A and 7B depict a top cross-sectional schematic view and a partial cross-sectional view, respectively, of an external portion 700 of an auditory prosthesis, and are described together. The external portion 700 includes a housing 702 in which two magnets 704, 706 are disposed. The magnets 704, 706 are of opposing polarities. Magnetic components 708 are movably disposed relative to the magnets 704, 706, and are disposed so as to bridge the gap 714 therebetween. The magnetic components 708 have a consistent width w. As depicted in FIG. 7B, however, the magnetic component 708 has a lesser height $H_1$ proximate a tip 710 and a greater height $H_2$ proximate a base 712. Thus, as the orientation of the magnetic component 708 changes, so too does the volume thereof that bridges the gap 714. A greater volume of magnetic component 708 bridging the gap 714 decreases the magnetic reluctance and increases the retention force with implanted magnets. Although the magnetic component 708 is trapezoidal in shape, other shapes, such as triangular and semi-circular, are contemplated.

Other configurations of magnetic components are contemplated so as to enable adjustment of the retention forces associated therewith. For example, magnetic components having varied magnetism across a body of the component can be utilized. In such an example, one end of the component can have a higher percentage of e.g., cobalt, while an opposite end can have a lower percentage thereof. In another embodiment, a first end of the magnetic component can be solid and the second end perforated, thus having a lower volume of material than the first end. Other embodiments utilizing a combinations of the structures described herein are contemplated.

Figure 8A:
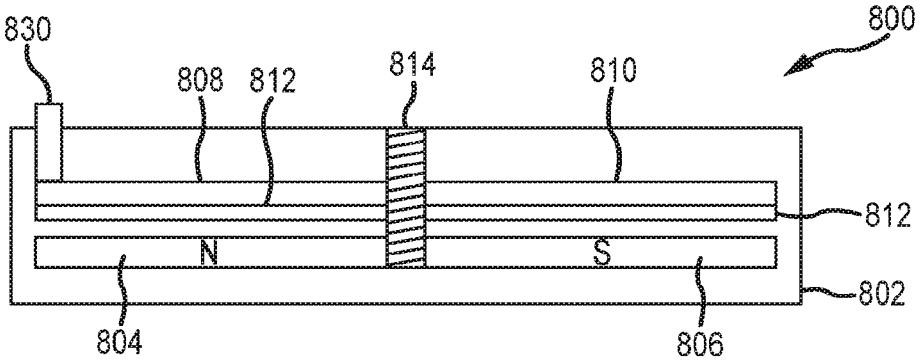
FIGS. 8A-8C depict partial cross-sectional schematic views of external portions of auditory prostheses.
Figure 8B:
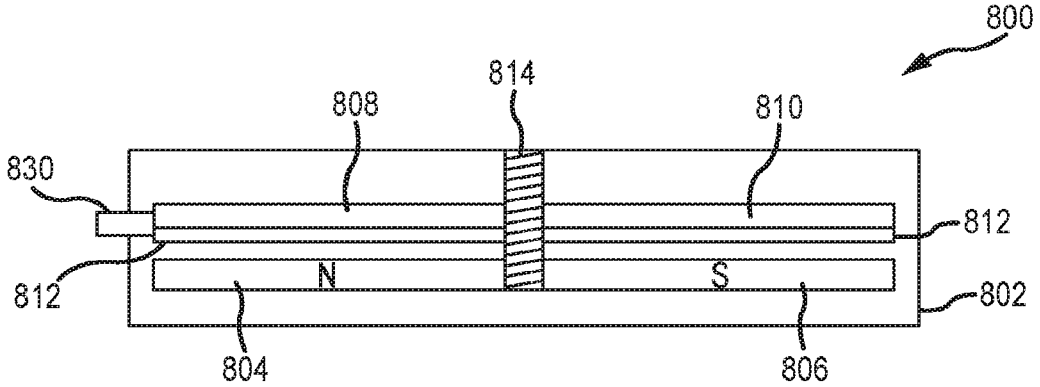
Figure 8C:
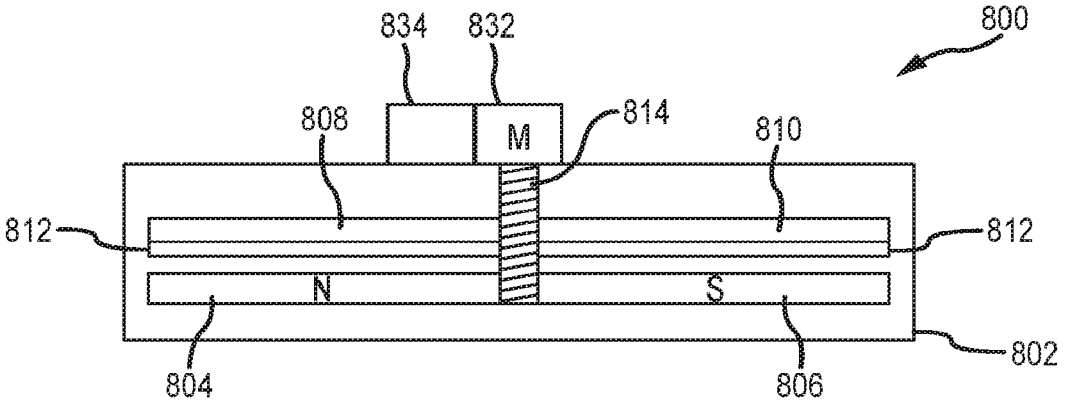

FIGS. 8A-8C depict partial cross-sectional schematic views of external portions 800 of auditory prostheses. The external portion 800 includes a housing 802 and two magnets 804, 806 disposed therein. A magnetic component 808, 810 is disposed proximate each of the magnets 804, 806, respectively. A single magnetic component can also be used. The magnetic components 808, 810 are mounted to a base 812 that can be positioned via a position adjustment system, in this case, a shaft 814. Other adjustment systems, such as those depicted in FIGS. 4B-4D, can be utilized. In FIG. 8A, a lever 830 penetrates a top part of the housing 802 so as to be accessed by a recipient to adjust the position of the magnetic components 808, 810, and accordingly, holding force as desired. In FIG. 8B, a lever 830 protrudes from a side of the housing 802. In FIG. 8C, a motor 832, such as a servo motor or a piezoelectric bender can be utilized. In the case of the embodiment depicted in FIG. 8C, the motor 832 can automatically adjust the position of the magnetic components 808, 810 based on, e.g., input from a sensor 834. The sensor 834 can be in direct communication with the motor 832, or can communicate via a processor (not shown). A variety of one or multiple sensors can be used. For example, the sensor 834 can detect a pressure between the external housing and the skin. Excess pressure (which can cause discomfort) detected by the sensor 834 can result in a signal being sent to the motor 832. The motor 832 can then adjust a position or orientation of the magnetic component 808, 810 to adjust the pressure. In another embodiment, the sensor 834 detects increased noise in the environment and sends a signal to the motor 832 to increase the retention force (which is particularly useful for sound transfer in bone conduction devices). In still another embodiment, the sensor 834 can be a pulse or movement sensor. An increased recipient pulse or movement can be indicative of increased or vigorous activity, such that increased retention force is desirable.

In other embodiments, the recipient could actuate a button on the housing 802, or the external portion 800 can include a wireless or wired communication system to communicate with an application or program installed on a portable or desktop computer, smartphone, or other device. In one embodiment, the recipient can adjust the retention force of her external portion by utilizing an app on her smartphone, for example, to increase retention force prior to running or other strenuous activity. Other methods of adjusting the retention force by altering orientation and/or position of the magnetic components are contemplated.

As described herein, the magnetic components can be of virtually any form factor or shape, as required or desired for a particular application. Contemplated shapes include rectangular, crescent, triangular, trapezoidal, and so on. Additionally, substantially plate-like or flat magnetic components are disclosed in several embodiments, but magnetic components having variable thicknesses are also disclosed. The total volume of the magnetic component affects the amount of magnetic flux that can be channeled therethrough, which ultimately affects the variability of the retention force between magnets in an external portion and an implanted portion. Thus, for systems utilizing a single magnet, a thicker magnetic component disposed proximate thereto will channel more magnetic flux than a thinner magnetic component, thus increasing the retention force. For systems utilizing two magnets, a magnetic component having a greater volume spanning the two magnets (based on varying height and/or width) will channel more flux, thus increasing the retention force. Therefore, magnetic components having varying thicknesses or widths, such as those described herein, are more versatile for adjusting the retention force in auditory prostheses.

The adjustable magnetic components described herein can be used in conjunction with magnet systems that utilize a single magnet or multiple magnets. For example, a first magnet having a north polarity can be disposed in an external portion while a second magnet having a south polarity can be implanted within the body. Adjusting the orientation or distance of a magnetic component relative to either or both of the north or south magnet affects the retention force. Similarly, adjusting the orientation or distance of a magnetic component relative to a pair of magnets in either an external portion or an implanted portion will adjust the retention force. The use of any number of magnets or magnetic components is considered within the scope of the disclosed technology. Additionally, the ability to change retention force can enable smaller or larger magnets to be utilized.

In certain embodiments, if a recipient in involved in a vigorous activity, such as running or swimming, a stronger force can be utilized to keep the external portion attached and in place. However, a weaker holding force could be used during less vigorous activities, so as to reduce recipient discomfort and, potentially, skin necrosis. A magnetic component can be disposed proximate either or both of the external magnet and/or implanted magnet to channel the magnetic field associated therewith. This field channeling affects the magnetic force between the two magnets, and thus the retention force on the external portion. The magnetic component can be moved relative to its associated magnet so as to adjust, control, or otherwise regulate the magnetic field, and thus, the retention force. This allows the recipient to easily adjust her auditory prosthesis, based on her desired activity.

Figure 9:
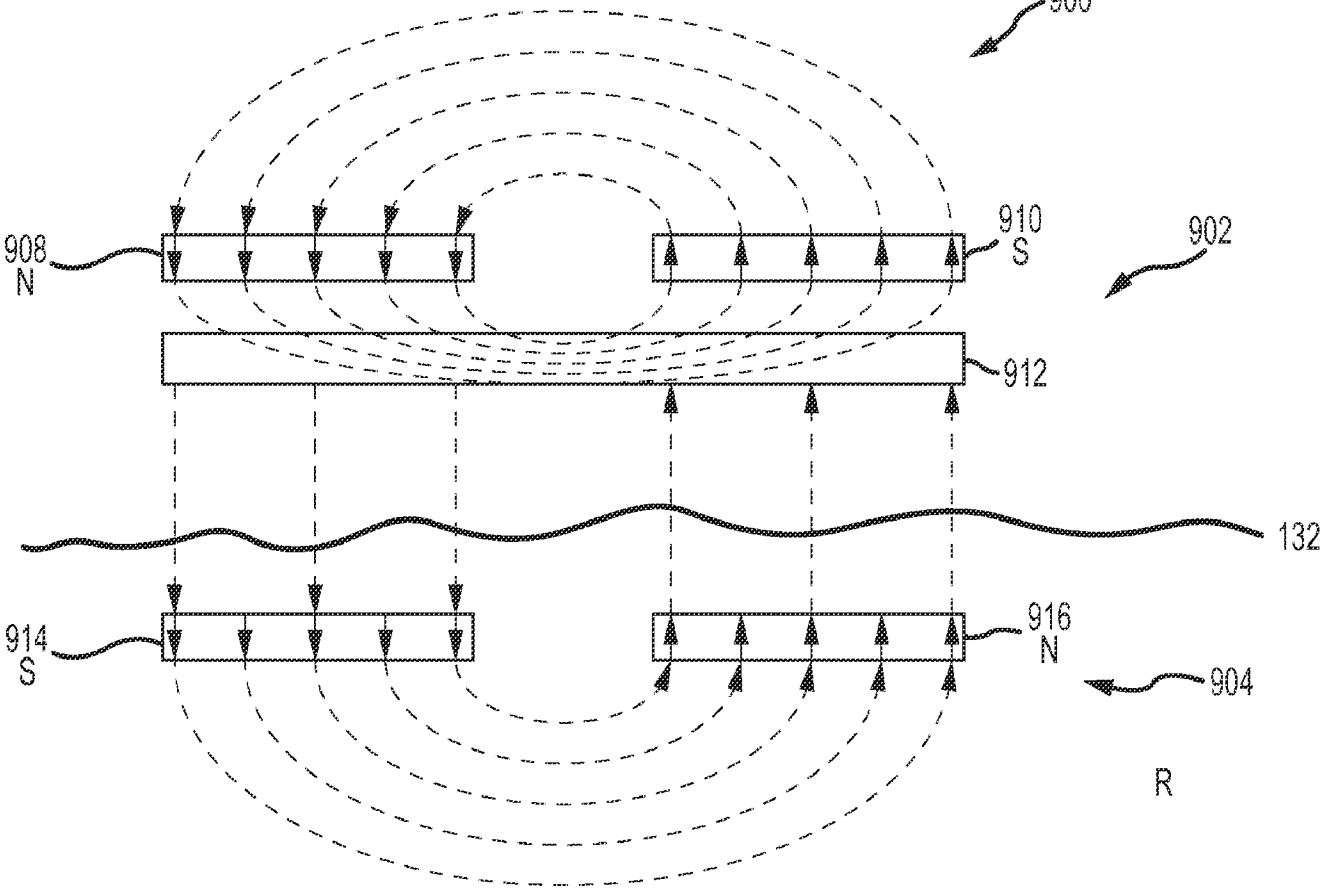
FIG. 9 depicts a partial cross-sectional schematic view of another embodiment of a passive transcutaneous bone conduction device worn on a recipient.

The embodiments described herein locate magnetic components on the outside of a paired set of magnets (e.g., one in an external portion, one in an implanted portion). In other embodiments, the magnetic components can be disposed between the external and implanted magnets. One such embodiment is depicted in FIG. 9, which depicts a partial cross-sectional schematic view of another embodiment of a passive transcutaneous bone conduction device 900 worn on a recipient R. Only skin 132 of the recipient R is depicted for clarity. The bone conduction device 900 includes an external portion 902 and an implantable portion 904. For clarity, only certain components of each of the external portion 902 and the implantable portion 904 are depicted. Other components in the external portion 902 and the implantable portion 904, e.g., sound processing components, batteries, microphones, actuators, anchors, etc., are described above, but not depicted in FIG. 9. The external portion 902 includes a plurality of external magnets 908, 910. In this embodiment, magnet 908 has a "north" polarity and magnet 910 has a "south" polarity. Disposed proximate each magnet 908, 910 is a magnetic component 912. The implantable portion 904 also includes two implantable magnets 914, 916, the polarities of which are oriented in a reversed configuration relative to the external magnets 908, 910 of the external portion 902.

Magnetic flux generated by the magnets 908, 910, 914, 916 is also depicted in FIG. 9. Stray portions are generally not depicted. In FIG. 9, the magnetic component 912 disposed between the magnets 908, 910, 914, 916, which short-circuits and therefore reduces flux reaching the inner magnet 914, 916, as to reduce the force. By utilizing this configuration, the retention force can be reduced to a lower level. The adjustment systems described herein can also be utilized in the depicted configuration to adjust a separation distance or orientation of the magnetic component 912, relative to the magnets 908, 910.

The magnetic flux can be channeled by locating the magnetic component proximate the magnets (and can thereby adjust the strength of the magnetic field). For example, in other embodiments, the magnetic components can be disposed to a side of one or more of the magnets. The position and orientation of magnetic components disposed on the side of a magnet can also be adjusted. As described herein, this will alter the magnetic flux and thus the retention force between external and implanted magnets.

This disclosure described some embodiments of the present technology with reference to the accompanying drawings, in which only some of the possible embodiments were shown. Other aspects, however, can be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An auditory prosthesis, comprising:

a housing;

two retention magnets of opposing polarities configured to secure the housing to a recipient; and a magnetic component disposed proximate the two retention magnets;

wherein the magnetic component disposition at least partially modifies a reluctance of a magnetic field generated at least in part by the two retention magnets;

wherein the magnetic component is configured to move relative to at least one of the two retention magnets to change a separation distance between the magnetic component and the at least one of the two retention magnets, and wherein the change in the separation distance between the magnetic component and the at least one of the two retention magnets is configured to alter a magnetic reluctance of the auditory prosthesis at least in part by changing how much the magnetic component modifies the reluctance of the magnetic field.

2. The auditory prosthesis of claim 1, wherein the auditory prosthesis further comprises an actuator and an adjustment system, the adjustment system being configured to move the magnetic component relative to the at least one of the two retention magnets, and wherein the actuator, the two retention magnets, the magnetic component and the adjustment system are disposed in the housing.

3. The auditory prosthesis of claim 2, wherein the two retention magnets are configured to hold the auditory prosthesis proximate skin of the recipient and support the weight of the auditory prosthesis.

4. The auditory prosthesis of claim 1, wherein the magnetic component short circuits flux from the two retention magnets.

5. The auditory prosthesis of claim 1, wherein the magnetic component bridges a gap between the two retention magnets.

6. The auditory prosthesis of claim 5, wherein the relative movement of the magnetic component changes an amount of flux channeled through the magnetic component.

7. The auditory prosthesis of claim 5, wherein the magnetic component overlaps the two retention magnets.

8. The auditory prosthesis of claim 1, wherein the relative movement of the magnetic component changes sound transfer characteristics of the auditory prosthesis.

9. The auditory prosthesis of claim 8, wherein the auditory prosthesis is a bone conduction device and the two retention magnets are configured to transfer vibrations from the auditory prosthesis to the recipient.

10. The auditory prosthesis of claim 1, wherein the relative movement of the magnetic component changes a force securing the housing to the recipient.

11. The auditory prosthesis of claim 1, wherein the magnetic component channels magnetic flux between the two retention magnets.

12. The auditory prosthesis of claim 1, wherein the auditory prosthesis further comprises an adjustment system configured to move the magnetic component.

13. An auditory prosthesis, comprising:

a housing;

a magnet arrangement comprising a first retention magnet and a second retention magnet, wherein the magnet arrangement is configured to secure the housing to a recipient;

a gap defined between the first retention magnet and the second retention magnet; and a magnetic component;

wherein at least one of the magnetic component and the magnet arrangement is configured to rotate relative to the other of the magnet arrangement and the magnetic component, and wherein relative rotation of the magnetic component with respect to the magnet arrangement is configured to adjust a volume of the magnetic component bridging the gap.

14. The auditory prosthesis of claim 13, wherein the magnetic component has a narrow portion proximate a tip of the magnetic component and a wide portion proximate a base of the magnetic component.

15. The auditory prosthesis of claim 13, wherein the relative rotation of the magnetic component changes a force securing the housing to the recipient.

16. The auditory prosthesis of claim 13, wherein the auditory prosthesis is a bone conduction device and the magnet arrangement is configured to transfer vibrations from the auditory prosthesis to the recipient.

17. An auditory prosthesis, comprising:

a housing;

two retention magnets of opposing polarities configured to secure the housing to a recipient; and a magnetic component disposed proximate the two retention magnets;

wherein the magnetic component disposition at least partially modifies a reluctance of a magnetic field generated at least in part by the two retention magnets;

wherein at least one of the magnetic component and the two retention magnets is configured to move relative to the other of the two retention magnets and the magnetic component, and wherein the relative movement of the magnetic component and one or both of the retention magnets actuates the magnetic component to bridge a gap between the two retention magnets to alter a magnetic reluctance of the auditory prosthesis at least in part by changing how much the magnetic component modifies the reluctance of the magnetic field.

18. The auditory prosthesis of claim 17, wherein the auditory prosthesis further comprises an adjustment system configured to move the at least one of the magnetic component and the two retention magnets relative to the other of the two retention magnets and the magnetic component.

19. The auditory prosthesis of claim 17, wherein the relative movement of the magnetic component and the one or both of the two retention magnets changes an overlap between the magnetic component and the two retention magnets.

20. The auditory prosthesis of claim 17, wherein the relative movement of the magnetic component and the one or both of the two retention magnets changes sound transfer characteristics of the auditory prosthesis.

* * * * *